United States Patent [19]

Maisch

[11] 4,244,334

[45] Jan. 13, 1981

[54] VALVE ACTUATING AND CONTROL CIRCUIT

[75] Inventor: Wolfgang Maisch, Frankreich, Fed. Rep. of Germany

[73] Assignee: Robert Bosch GmbH, Stuttgart, Fed. Rep. of Germany

[21] Appl. No.: 886,321

[22] Filed: Mar. 13, 1978

[30] Foreign Application Priority Data

Mar. 14, 1977 [DE] Fed. Rep. of Germany ..... 2710989

[51] Int. Cl.[2] ..... F02M 7/12

[52] U.S. Cl. ..... 123/325; 123/332; 123/198 DB; 123/DIG. 11

[58] Field of Search ..... 123/198 DB, 110, 102, 123/97 B, DIG. 11

[56] References Cited

U.S. PATENT DOCUMENTS

| | | | |
|---|---|---|---|
| 3,310,044 | 3/1967 | Haverstick | 123/110 |
| 3,601,103 | 8/1971 | Swiden | 123/102 |
| 3,618,581 | 11/1971 | Simonet | 123/198 DB |
| 3,693,603 | 9/1972 | Lemanczyk | 123/102 |
| 4,075,988 | 2/1978 | Kato | 123/102 |
| 4,078,631 | 3/1978 | Kadota et al. | 123/102 |
| 4,083,267 | 4/1978 | Raaz | 123/102 |
| 4,094,274 | 6/1978 | Hanada | 123/198 DB |

*Primary Examiner*—Ira S. Lazarus

*Attorney, Agent, or Firm*—Edwin E. Greigg

[57] ABSTRACT

A circuit for actuating control elements, for example a fuel shutoff valve in the carburetor of an internal combustion engine or a similar control element. The circuit is responsive to engine speed and to throttle valve position as monitored via the intake manifold vacuum. When the engine idles and the throttle is closed, the fuel control valve is held open to supply normal idling fuel or fuel mixture. However, if the engine speed rises above a threshold speed while the throttle is closed, the control circuit assumes a condition of engine braking and the fuel supply is interrupted. The switching threshold is established as the voltage on a capacitor controlling a transistor, the capacitor being charged continuously and being discharged during the occurrence of voltage spikes taken from the ignition coil of the vehicle.

10 Claims, 2 Drawing Figures

VALVE ACTUATING AND CONTROL CIRCUIT

BACKGROUND OF THE INVENTION

The invention relates to the fuel management of internal combustion engines. More particularly, the invention relates to a fuel or fuel mixture shutoff mechanism which is installed for the purpose of preventing the unintentional combustion in the cylinders of the engine after ignition shutoff, i.e. so-called "dieseling". In known engines and fuel management systems for motor vehicles, there are provided idle cutoff mechanisms which, for example, block off the idle jet in the carburetor and thus prevent dieseling.

In fuel injection systems, it is known to connect the exciter coil of fuel injection valves in series with a semiconductor element which is driven, in most cases, by a driver transistor or driver stage.

It has been further proposed, for example in U.S. Patent application Ser. No. 794,885, the contents of which are hereby expressly incorporated into the present application, to provide an rpm-dependent circuit ahead of the driver circuit so as to perform the idle fuel or idle mixture shutoff in carburetors when the engine is being overrun, i.e. during engine braking. The rpm-dependent circuit responds when a particular engine speed is reached and energizes a magnetic shutoff valve which insures that the fuel supply to the engine is not interrupted when the engine is actually and intentionally idling. the known system proposed in the aforementioned patent application Ser. No. 794,885 further includes a pressure switch, preferably a vacuum switch, disposed in association with the induction tube and intended to monitor the position of the throttle. This vacuum switch also causes actuation of the magnetic valve in certain states. The present invention relates particularly to the input portion of the aforementioned apparatus and constitutes an improvement of a variety of aspects of this system.

OBJECT AND SUMMARY OF THE INVENTION

It is thus a principal object of the present invention to provide improvements in the input and control circuitry of a system for insuring fuel or fuel mixture shutoff for an internal combustion engine. It is a further object of the present invention to provide input and control circuitry for the fuel shutoff system which is insensitive to spurious pulses and voltages and which is capable of being used in association with any known and customary ignition systems employing high-voltage coils. It is a further object of the invention to provide the input and control circuitry for a fuel shutoff system so constructed as to be largely independent on the power supply voltage and the ambient temperature.

Yet another object of the present invention is to provide fuel shutoff control circuitry which can deliver an increased actuation potential for the magnetic shutoff valve, thereby insuring increased reliability.

These and other objects are attained according to the present invention by providing a fuel mixture shutoff system in which a magnetic valve, when energized, supplies an idling fuel quantity and wherein the magnetic valve is controlled by a power transistor which is actuated by an input circuit. The input circuit includes a transistor associated with three energy storage elements, in particular capacitors, so connected as to receive a relatively short ignition pulse present at the ignition coil of the engine. The input circuit processes this short-term pulse in such a way as to permit a distinction to be made between engine braking and genuine engine idling., i.e. cases where the throttle valve is normally closed.

The first capacitor is connected in the base circuit of the input transistor and is charged by the ignition pulse. A second capacitor is coupled into the collector-emitter branch of the input transistor and can be discharged when the input transistor conducts while being charged from the power supply when the input transistor is blocked. The second capacitor in turn charges a third capacitor which is connected in the base circuit of a driver transistor which finally actuates the output stage.

The invention will be better understood as well as further objects and advantages thereof become more apparent from the ensuing detailed description of several preferred embodiments taken in conjunction with the drawing.

DESCRIPTION OF THE PREFERRED EMBODIMENTS

Figure 1:
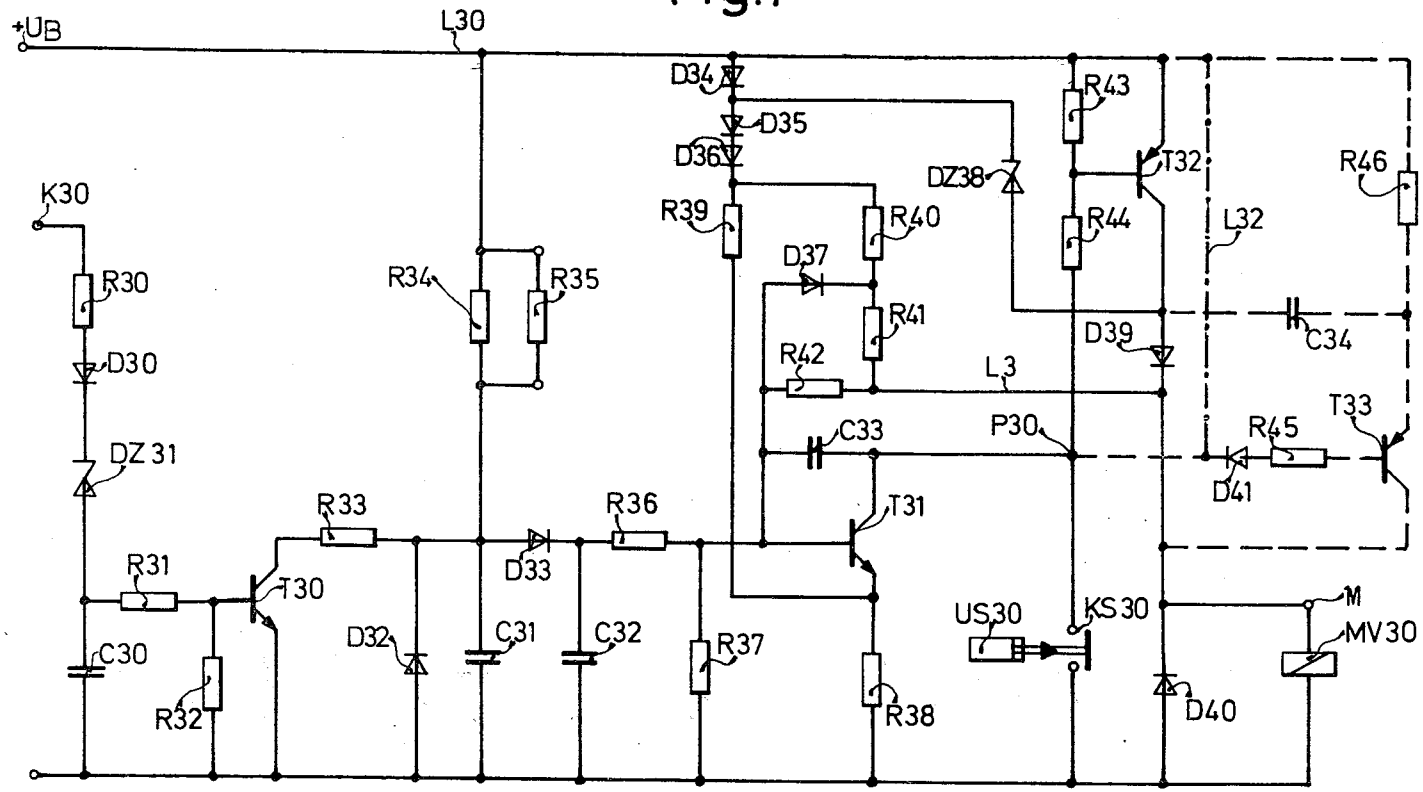
FIG. 1 is a detailed circuit diagram of the electronic control circuitry for a fuel shutoff mechanism according to the present invention.

Turning now to FIG. 1, there will be seen a circuit including the actuation solenoid MV30 of a solenoid valve which would be disposed in the idling fuel or idling mixture conduit of a carburetor, for example as described in the aforementioned U.S. patent application Ser. No. 794,885. The manner in which this valve is connected and the details of its construction are contained in this aforementioned application and will not be treated in detail here. Furthermore, the actuation of the magnetic valve MV30 by a vacuum operated switch US30 with contacts KS30 is also substantially similar to the system described in the aforementioned patent application. In particular, the contacts KS30 are connected as shown to the base of an output transistor T32 which, when conducting, is seen to provide actuation current to the solenoid valve MV30. The present invention concerns itself primarily with the input and driving circuitry for the output transistor T32 as will now be explained in detail. In the present invention, the input circuitry includes an input transistor T30, the base of which is coupled at a contact K30 to receive ignition pulses at any suitable point of the ignition coil of an engine. The emitter of the transistor T30 is connected to ground or the negative supply line while an input resistor R31 is connected in series with a capacitor C30, the other side of which is grounded. A base drain resistor R32 is connected between the base and ground. Connected between the junction of the capacitor C30 and the resistor R31 and the input K30 are, in series, a Zener diode DZ31, a simple diode D30 and a resistor R30. Connected to the collector of the transistor T30 via a resistor R33 are, in parallel, a diode D32 and a capacitor C31. The capacitor C31, being connected between the two voltage supply lines across parallel resistors R34 and R35, will be seen to be charged continuously at a rate determined by the size of the resistors. It will be appreciated by the person skilled in the art that any indicated polarities and types of the various transistor and semiconductor elements are merely exemplary and could be exchanged for suitable types of opposite polarity with appropriate changes being made in the connection.

Connected in parallel with the capacitor C31 across a diode D33 is a capacitor C32 which is connected as shown via an input resistor R36 to the base of a driver transistor T31. This transistor T31 has a base current resistor R37 and an emitter resistor R38 connected to the negative supply line or ground.

The collector of the transistor T31 is connected to the base of the output transistor T32 via a voltage divider chain consisting here of resistors R44 and R43. At a circuit point P30, the collector of the transistor T31 is also connectable to ground by a vacuum-operated switch US30 acting via contacts KS30.

It will be appreciated that any suitable switch could be used in place of the vacuum switch US30, in particular any switch which is responsive to the throttle valve position of the engine, either directly or via the manifold vacuum. The vacuum switch US30 of the present invention is comparable to the vacuum switch having contacts KS2 of the aforementioned U.S. patent application Ser. No. 794,885 and the output transistor T32 in the present application is comparable to the output transistor T4 in application Ser. No. 794,885.

The emitter of the output transistor T32 is connected to the positive supply line while its collector is connected via a diode D39 with indicated polarity to the actuation coil of the magnetic valve MV30 which provides the selectable flow of idling fuel or fuel mixture for the engine.

A diode D40 is seen to be connected in parallel with the magnetic valve MV30. The remaining elements of the circuit of FIG. 1 will be discussed below in connection with the discussion of the operation of the overall circuit.

In commonly used ignition systems of motor vehicles, one contact of the ignition coil carries an initially sinusoidal pulse of 200 to 300 V, depending on the make, and having a pulse width of approximately 100 $\mu$s. This generally positive ignition pulse is received at the contact K30 and charges the capacitor C30 via the resistor R30, the diode D30 and the Zener diode DZ31. The change accumulated on the capacitor C30 can dissipate to ground via the resistors R31 and R32 as well as through the base-emitter path of the transistor T30. The presence of these generally highly resistant elements permits only a very relatively slow discharge of the capacitor C30 while holding the transistor T30 in the conducting state. When the transistor T30 conducts, the capacitor C31, previously charged up from the positive supply line L30, now discharges through the transistor T30 to ground. The magnitude of the discharge current from the capacitor C31 is limited in suitable manner by a resistor R33. In a particular engine, for example a 4-cylinder engine running at a speed of 1500 rpm, the capacitor C31 discharges in a time of approximately 0.5 to 1 ms which is considerably smaller than its charging time of approximately 20 ms. The discharge time constant of the capacitor C30 at the base of the transitor T30, given approximately by the product C30 $\times$R31, is somewhat larger than the discharge time constant of the capacitor C31 given approximately by the product C31$\times$R33 so that the capacitor C31 is reliably discharged at each occurrence of an ignition pulse. The magnitude of the input resistor R30 is chosen high enough so that the present circuit does not represent a significant electrical load for the ignition pulse taken from the coil. The presence of the diode D30 insures that the capacitor C30 cannot discharge through the input contact K30 after the ignition pulse has decayed. Any further pulses occurring at the ignition coil only serve to charge the capacitor C30 further, but the durations of such additional charging pulses are negligible compared to the normal pulse durations. The Zener diode DZ31 insures that the occurrence of the positive pulse of approximately 50 V which occurs after the ignition spark has terminated, i.e. after approximately 1 ms, does not again charge the capacitor C30 and therefore cannot initiate further and erroneous discharges of the capacitor C31.

When the input pulse at the transistor T30 has decayed, and this transistor blocks, the capacitor C31 begins to recharge through the parallel resistors R34/R35. The resistor R35 serves to provide the only required adjustment of the circuit to the desired conditions so that all deviations from nominal design magnitudes of the remaining circuit elements can thereby be compensated for. If the voltage on the capacitor C31 exceeds the voltage on the capacitor C32, the latter is charged up via the peak rectifier D33. The voltage on the capacitor C32 substantially remains intact even when the capacitor C31 discharges inasmuch as the charge on the capacitor C32 has to flow through the high-valued resistors R36 and R37 and the base-emitter portion of the transistor R31 and the resistor R38.

The combination of the transistors T31 and T32 constitutes a motor speed dependent threshold switch. The response to motor speed, i.e. the frequency of occurrence of the ignition pulses at the contact K30, comes about in the following way. If the engine speed is relatively low, for example at idling rpm, it must be assumed that the engine is deliberately being idled so that fuel or fuel mixture must be provided and the magnetic valve should be energized. At the idling speed, the frequency of occurrence of the ignition pulses and hence the frequency of discharging events for the capacitor C31 is relatively low so that the voltage on the capacitor C32 remains high and keeps the transistor T31 conducting. As a result, the voltage at the circuit point P30 is pulled to low values, thereby rendering the transistor T32 conducting and causing current to flow through the windings of the magnetic valve 30. The energized manetic valve 30 then releases the flow of idling fuel or fuel mixture in a suitable manner, for example as described in the aforementioned Patent Application. The output transistor T32 will also be opened if the throttle valve or manifold pressure dependent switch US30 closes, so that the contacts KS30 connect the circuit point P30 to ground. The closure of the switch contacts KS30 will take place when the throttle is not fully closed, which will indicate that the engine is not being used to decelerate the vehicle, i.e. is not being overrun, and requires fuel.

The main purpose of the remainder of the circuit is to render the threshold rpm at which the fuel shutoff valve is energized independent of changes in the supply voltage and ambient temperature. For this purpose, there are provided three series-connected diodes D34, D35 and D36, connected as shown from the positive supply line L30 via a resistor R39 to the emitter of the transistor T31. The junction of the diode D36 and the resistor R39 is connected through series resistors R40, R41 and R42 to the base of the transistor T31. The capacitor C33 connected between the base and the collector of T31 serves to suppress spurious pulses. A diode D37 is connected in parallel to the resistors R41 and R42 and normally prevents current flow in that branch. The diode D37 is provided to prevent the destruction of the output transistor T32 if the contact M of the magnetic valve MV30 is accidentally grounded, for example during installation or testing. For if the contact M is grounded, the diode D37 becomes conducting and blocks the transistor T31 which in turn blocks the transistor T32. The diode D39 also protects the transistor T32 against an erroneous switching of battery polarities. The same purpose is served by the diode D32 which protects the transistor T30 and the capacitors C31 and C32. In addition to serving as voltage and temperature compensation, the diode D34 acts as a protection for the Zener diode DZ38 in case of inverted polarity when a further capacitor C34 is charged via a transistor T33 in a supplementary circuit to be discussed below. It has been pointed out in the application Ser. No. 794,885 that it may be advantageous to supply the magnetic valve MV30 with a temporarily increased actuation voltage for the purpose of rapid and reliable response. For this purpose, the portion of the circuit of FIG. 1 shown in dashed lines permits raising the actuation voltage of the solenoid valve beyond the battery voltage $U_B$ without the use of mechanical relays. To obtain this end, there is provided a further transistor T33 whose collector is connected to the contact M of the valve MV30 and whose emitter is connected through a resistor R46 to the positive line L30. The emitter of T33 is further connected via a capacitor C34 to the collector of the output transistor T32. The base of the transistor T33 is connected via a diode D41 and a resistor R45 to the previously referred to junction P30, i.e. to the collector of the transistor T31. The last described portion of the circuit operates as follows: When the solenoid valve MV30 is not energized, the capacitor C34 can charge to the battery potential via the resistor R46, the diode D39 and the coil of the solenoid valve MV30. When the engine speed is less than the threshold speed, i.e. is close to the normal idling speed of the engine, the transistors T31 and T32 both conduct, as does the supplementary transistor T33 whose base is connected to substantially ground potential by the collector of the transistor T31. The collector fo the transistor T32 now pulls one electrode of the capacitor C34 from ground to the vicinity of the battery potential causing the other electrode of the capacitor C34 to carry approximately twice the battery voltage. The transistor T33 being in the conducting state, its collector and hence the coil MV30 temporarily receives almost twice the battery voltage. While the capacitor C34 discharges via the transistor T33 and the coil of the valve MV30, the diode D39 blocks. Resistor R42 effects a positive feed-back to the gate of transistor T31 thereby increasing the dynamic reaction. The diode D41 insures that the transistor T33 instantly blocks when the magnetic valve MV30 is switched off so that it is not excessively loaded by any short-term change in polarity of the emitter-base portion which might cause a breakdown.

A second exemplary embodiment of the supplementary portion of the circuit which permits a temporary increase of the valve actuation voltage is indicated by the dash dotted connection L32 which connects the diode D41 to the positive supply line. In the normal case, i.e. when the transistors T32 and T33 both block, the capacitor C34 is able to charge substantially to the positive battery voltage $+U_B$. When the transistor T32 becomes conducting, the potential at the emitter of T33 jumps to roughly twice the battery voltage, causing the transistor T33 to conduct and permitting the desired increase of the valve actuation voltage. Advantageously, the base current drawn by the transistor T33 does not load the transistor T31 during the increased voltage phase. For this reason, all other circuit elements, in particular the resistor R44, can be identical to the case where the circuit does not contain a voltage amplifier section. The function of the transistor T33 is unaffected in this embodiment because it conducts only until the capacitor C34 discharges and the voltage at the emitter of T33 has dropped to approximately the positive battery supply voltage.

Figure 2:
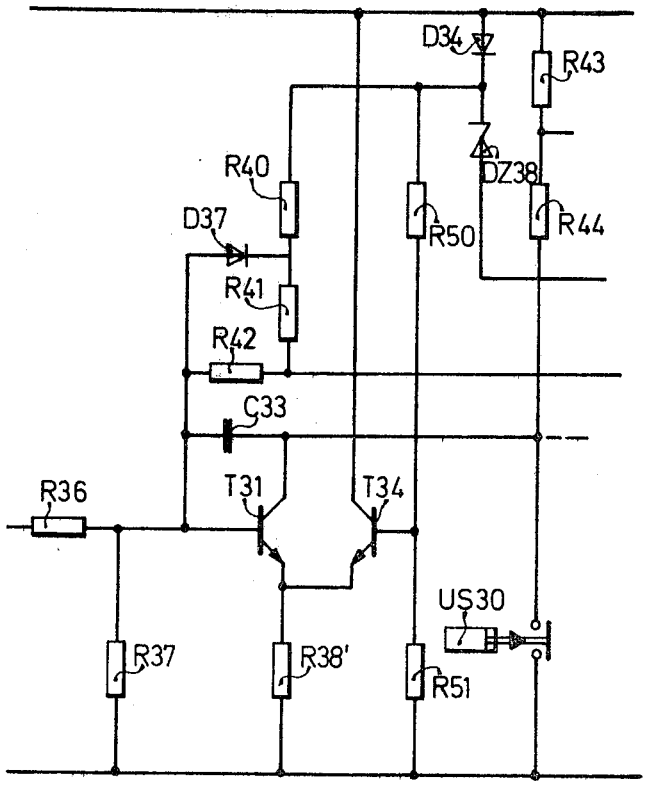
FIG. 2 is a partial diagram illustrating a second example of a portion of the input circuitry of FIG. 1.

A second embodiment of the overall invention is illustrated in part in FIG. 2. It will be recalled that the embodiment of FIG. 1 included an input transistor T31 which could be rendered conducting at a certain time by one voltage occurring at the capacitor C32. This threshold voltage at which the transistor T31 of FIG. 1 became conducting could be adjusted by adjusting the voltage divider consisting of resistors R38 and R39 and the diodes D34, D35 and D36. In the present embodiment illustrated in FIG. 2, the threshold voltage for the transistor T31 is adjusted with the aid of a further transistor T34 connected as shown. The emitter of the transistor T34 is connected to the emitter of T31 while its collector is at positive voltage. The reference voltage divider, consisting of resistors R50 and R51, is connected to the junction of the diode D34 and the Zener diode DZ38. In this circuit, the diodes D35 and D36 may be omitted and the free electrode of the resistor R40 is now connected to the cathode of the diode D34. The transistor T34 permits an exact compensation for temperature and voltage changes so that this circuit embodiment becomes virtually independent of changes in the supply voltage and the ambient temperature.

It is to be regarded as a significant advantage of the circuits described by the present invention that the engine speed sensitive circuitry described here requires only a single transistor and that it can be supplied with an electrical pulse which is present in virtually any known and commonly used ignition systems using coils. Furthermore, the imput circuitry is very immune to spurious pulses and does not require the condensor which is normally used for a monostable switching device.

Yet another advantage is that the engine speed at which the magnetic valve is re-energized is also substantially independent of battery voltage and ambient temperature and that the increased voltage for the actuation of the magnetic valve is obtained by purely electronic means.

The foregoing relates to preferred exemplary embodiments of the invention, it being understood that other embodiments and variants thereof are possible within the spirit and scope of the invention.

What is claimed and desired to be secured by Letters Patent of the United States is:

1. An apparatus for actuating control elements, especially for actuating a fuel shutoff mechanism in the fuel supply system of an internal combustion engine with spark ignition provided by a spark coil, said fuel shutoff mechanism including a solenoid valve having actuating windings connected in series with a power transistor, said power transistor being controlled by a driver transistor in a primary circuit which also includes switch means responsive to engine speed and switch means responsive to intake manifold pressure and wherein the improvement comprises that said primary circuit further includes:

an input transistor whose base electrode is connected to a first capacitor which is also connected to said spark coil to be charged thereby;

a second capacitor connected to a power electrode of said input transistor to be discharged therethrough; and a third capacitor, connected in parallel with said second capacitor via a diode and also connected to the base of said driver transistor.

2. An apparatus as defined by claim 1, further comprising at least one diode connected between said spark coil and said first capacitor, said first capacitor being charged rapidly via said diode and discharged more slowly while rendering said input transistor conducting, and further comprising adjustable resistor means connected between said second capacitor and a source of electrical power, the magnitude of the capacitance of said first and second capacitor and the associated resistances being such that the charging time of said second capacitor is substantially larger than the discharge time constant of said first capacitor; whereby said driver transistor is rendered conducting by said third capacitor only when the frequency of occurrence of pulses from said spark coil exceeds a predetermined frequency.

3. An apparatus as defined by claim 2, wherein the improvement further comprises a voltage divider connected to the emitter of said driver transistor for supplying an adjustable emitter voltage.

4. An apparatus as defined by claim 3, further comprising a second voltage divider connected to the base of said power transistor and also connected to the collector of said driver transistor, said second voltage divider serving to adjust the bias voltage for the base of said power transistor and being further connected with the switching contacts of said switch responsive to induction manifold pressure.

5. An apparatus as defined by claim 1, further comprising a switching transistor whose base is connected to the collector of said driver transistor and a fourth capacitor so connected to said switching transistor and said solenoid valve that said switching transistor can connect said fourth capacitor in series with the actuation coil of said solenoid valve.

6. An apparatus as defined by claim 5, wherein said fourth capacitor has one electrode connected through a resistor to a source of positive voltage and a second electrode connected via a diode and the actuation coil of said solenoid valve to the opposite polarity of the supply voltage and to the collector of said power transistor; whereby, when said power transistor conducts and said switching transistor conducts, the actuation coil of said solenoid valve is connected in series with the collector-emitter paths of both said output transistor and said switching transistor and with said fourth capacitor.

7. An apparatus as defined by claim 1, wherein the electrode of the actuation coil of said solenoid valve normally receiving postitive actuation voltage is connected via a resistor to the base of said driver transistor.

8. An apparatus as defined by claim 1, further comprising a Zener diode connected in series with said first capacitor for suppressing ignition pulses of low voltage which occur at the termination of the ignition spark.

9. An apparatus as defined by claim 1, further comprising a transistor (T34) for defining a threshold potential for the emitter of said driver transistor, and a voltage divider (R50, R51) for providing a reference voltage to the base of said transistor (T34).

10. An apparatus as defined by claim 1, further comprising a switching transistor whose base is connected to the collector of said driver transistor and a fourth capacitor so connected to said switching transistor and said solenoid valve that said switching transistor can connect said fourth capacitor in series with the actuation coil of said solenoid valve and wherein the base of said switching transistor is connected via a diode (D41) to the positive voltage supply of said apparatus.

* * * * *